US009797089B2

(12) United States Patent
Long et al.

(10) Patent No.: US 9,797,089 B2
(45) Date of Patent: Oct. 24, 2017

(54) METHOD OF PHOTOCATALYTIC WHITE DISCHARGE PRINTING FOR ACHIEVING PATTERNS ON TEXTILES

(71) Applicant: Soochow University, Suzhou, Jiangsu Province (CN)

(72) Inventors: Jiajie Long, Suzhou (CN); Hongmei Xu, Suzhou (CN); Aidong Wang, Suzhou (CN)

(73) Assignee: Soochow University, Suzhou (CN)

( * ) Notice: Subject to any disclaimer, the term of this patent is extended or adjusted under 35 U.S.C. 154(b) by 0 days.

(21) Appl. No.: 14/758,594

(22) PCT Filed: Apr. 2, 2013

(86) PCT No.: PCT/CN2013/073611
§ 371 (c)(1),
(2) Date: Jun. 30, 2015

(87) PCT Pub. No.: WO2014/117432
PCT Pub. Date: Aug. 7, 2014

(65) Prior Publication Data

US 2015/0337488 A1 Nov. 26, 2015

(30) Foreign Application Priority Data

Feb. 1, 2013 (CN) ..... 2013 1 0040260

(51) Int. Cl.

| | |
|---|---|
| ***D06P 5/15*** | (2006.01) |
| ***D06P 1/38*** | (2006.01) |
| ***D06P 3/66*** | (2006.01) |
| ***D06P 5/20*** | (2006.01) |

(52) U.S. Cl.
CPC ..... *D06P 5/2005* (2013.01); *D06P 1/38* (2013.01); *D06P 3/66* (2013.01); *D06P 5/15* (2013.01); *D06P 5/153* (2013.01); *D06P 5/158* (2013.01)

(58) Field of Classification Search
CPC .. D06P 5/15; D06P 5/158; D06P 5/183; D06P 5/2005; D06P 1/38; D06P 3/66
See application file for complete search history.

(56) References Cited

U.S. PATENT DOCUMENTS

| | | | | | |
|---|---|---|---|---|---|
| 1,900,167 | A * | 3/1933 | Dreyfus | D06P 5/12 | 8/450 |
| 1,926,086 | A * | 9/1933 | Dreyfus | D06P 5/15 | 8/458 |
| 2,531,886 | A * | 11/1950 | Mills | B41L 45/00 | 101/48 |
| 3,103,404 | A * | 9/1963 | Salvin | D06P 5/155 | 8/464 |
| 2007/0226919 | A1* | 10/2007 | Mheidle | D06P 1/0032 | 8/446 |

FOREIGN PATENT DOCUMENTS

| | | | |
|---|---|---|---|
| CN | 101429730 | A | 5/2009 |
| CN | 101638855 | A | 2/2010 |
| CN | 101787644 | * | 7/2010 |
| CN | 101787644 | A | 7/2010 |
| KR | 20030080421 | A | 10/2003 |

* cited by examiner

*Primary Examiner* — Amina Khan
(74) *Attorney, Agent, or Firm* — SZDC Law P.C.

(57) ABSTRACT

A method for photocatalytic white discharge printing for achieving patterns on textiles includes closely integrating substrates with patterned printing plates or fixing patterned printing plates on one or both sides of a substrate, placing them in a reactor equipped with a light source and containing the photocatalytic white discharging formulation. The method has the characteristics of a simple process, short processing, easy controlling and wide adaptability. The process eliminates the need for printing plates and expensive printing apparatus used in complicated conventional printing methods. Additionally, the photocatalytic solution can be reused which avoids generous application of chemical agents and waste discharges that are present in conventional printing methods. The method is beneficial for cutting costs, saving energy, reducing emissions and has cleaner production.

4 Claims, 5 Drawing Sheets

METHOD OF PHOTOCATALYTIC WHITE DISCHARGE PRINTING FOR ACHIEVING PATTERNS ON TEXTILES

This application is a National Stage Application of International Application No. PCT/CN2013/073611, filed on Apr. 2, 2013, which claims the benefit of Chinese Application No. 201310040260.7, filed on Feb. 1, 2013, all of which are hereby incorporated by reference in their entirety for all purposes as if fully set forth herein.

FIELD

The present invention relates to a method of photocatalytic white discharge printing for achieving patterns on textiles. More particularly, it relates to a method of achieving patterns on textiles with light source that initiating reaction to reducing agent, oxidant or semiconductor nanomaterial. Thus, present invention belongs to the field of textile dyeing and finishing technology.

BACKGROUND

White discharge printing is a printing method achieving localized discoloration and getting diverse patterns through the way that dyed ground is printed with a paste containing discharging agents (normally reducing agent or oxidant), then the dyes are discharged destructively from the selected areas. Compared with direct printing, it receives more attentions due to its special printing effects that possessing dark ground and pastel shade, attractive small motif and fine line work, rich-layer patterns, boldly contrasting colors, higher sharpness and abundant ground shades.

The process of white discharge printing can be roughly divided into two steps. The fabrics are dyed, and then the designs are printed on the fabrics. Because of the existence of chemical agents (such as the strong reducing agent or oxidant, namely discharging agent), the ground shade is destroyed subsequently by steaming stage, and white patterns or dark ground and pastel shade is obtained, which makes up the defects of the direct printing.

Conventional white discharge printing is considered as a process with complicated procedures, following with numerous factors that affecting the effects of white discharge. That is to say conditions are difficult to control.

The main factors with effect of white discharge printing are the type of dye structure and its substantivity to fibres. Owing to the different stabilities or sensitivities of dye matrix structures to discharging agents, the capabilities of discharging of ground shades are directly influenced. Moreover, the size of decomposed products of dyes, the affinity to fibers, the color depth and so on, are directly affect the effect of white discharge printing. At the same time, desizing in the conventional white discharge printing also apparently affect the removal of decomposed product, as well as the effect of white discharge printing. In addition, the selection of discharging agents in printing pastes and types of fabrics, control of steaming process are also have an impact on the effect white discharge printing.

Conventional discharge printing not only makes large demands on consumption of chemicals, but also the energy, which account for higher costs. Meanwhile, varieties of residual chemicals in the printing pastes would cause a great threat to the environment.

Consequently, instead of the conventional process, providing an efficient and green environmental protecting method of white discharge printing process can decrease the energy consumption, reduce the applications of common chemicals and facilitate the achievement of cleaner production. Hence, it has an important significance of realization of energy saving and emissions reduction in enterprises of textile dyeing and printing.

Concrete Instance

In order to overcome the existing problems of the technology, present invention provides a method of achieving white patterns on textiles in the condition of normal pressure and temperature with single apparatuses and process, having advantages of energy saving, emission reduction and cleaner production.

A method of photocatalytic white discharge printing for achieving patterns on textiles includes the following steps:

1. Dye the substrates with dyes and get the dyed products;
2. According to the required patterns, form hollow-out decorative patterns with materials which are opaque and thin or thick films by physical or chemical method, so the patterned printing plates are obtained.
3. Closely integrate patterned printing plates and substrates, or the patterned printing plates are fixed in one side or both sides of the substrates; then put them in a reactor equipped with a light source and occupied by photocatalytic white discharge formulation, and air or oxygen is pumped into it; Opening the lamp, the dyed textiles are directly exposed to the light as described through the hollow-outs in the patterned printing plates, and treat them about 1~90 minutes in the condition of the temperature ranging from 5° C. to 70° C. The components of photocatalytic white discharge formulation as described include potassium persulfate, hydrogen peroxide, sodium sulfite, sodium hyposulfite, sodium hydrosulfite and one of nano $TiO_2$ and doping nano $TiO_2$, or any combination of them, additionally, the concentration is 0.10 g/L~10.00 g/L, and the pH value is 2~12.
4. Wash and dry the textiles removed from the photocatalytic white discharging bath at room temperature or dry it. Then the coloured products with white patterns are obtained.

In present invention, the dyes described are one of Reactive Red X-3B, Reactive Red M-3BE and Reactive Blue222BF, or any combination of them.

The patterned printing plates described are produced by mechanical or manual engraving or laser etching.

The light source described is ultraviolet or visible light, whose power is 5~500 w.

Compared with present technology, the invention has advantages as follows: due to the decomposition of photocatalytic white discharging agents caused by the technology of photocatalysts, highly active substances are produced or released, achieving localized discoloration and white patterns on fabrics; simple experimental conditions and process, wide adaptability of pH values, easy controlling and high productivity are occupied, eliminating the need for printing pastes and complicated process of steaming in the conventional printing method; additionally, photocatalytic solution can be reused after supplement, avoiding generous applications of chemical agents and waste discharges in the conventional printing method. It is beneficial to cutting costs, possessing the significant advantages of energy saving, emission reduction and cleaner production. Thus, the invention has a very glorious prospect of application in the cleaner production of textile dyeing and printing industries.

Figure 1:
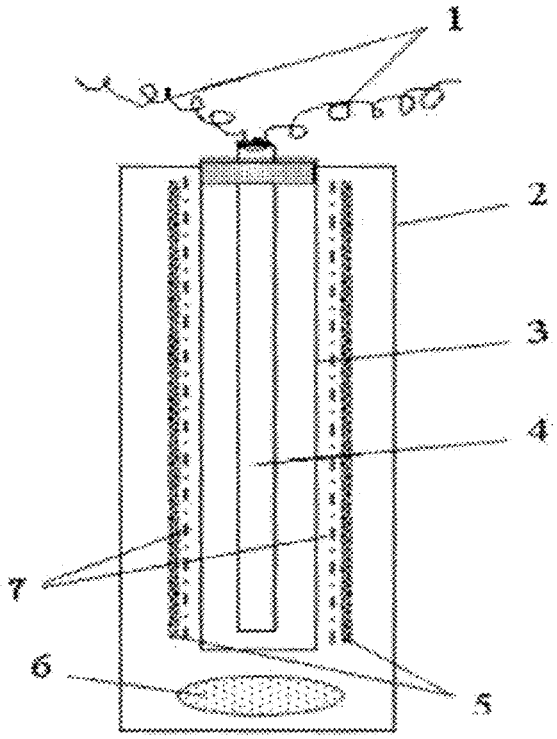
FIG. 1 of the drawings is the schematic of a reactor provided by present invention, and it is used for achieving patterns on textiles adopting the method of white discharge batch printing.

In the FIG. 1: 1. Power supply wiring (omitting the power); 2. Batch process unit; 3. Tube of quartz; 4. Low-pressure mercury violet lamp; 5. Dyed textiles; 6. Device of Aeration; 7. Patterned printing plate.

Concrete Instance

Combined with the appended drawings and specific examples, make a further illustration for this invention, and the concrete chemicals involved are as follows:

Ground shade dyes: Reactive Red X-3B, Reactive Red M-3BE and Reactive Blue222BF are commonly commercial products.

Photocatalytic white discharging agent: potassium persulfate ($K_2S_2O_8$), hydrogen peroxide ($H_2O_2$), sodium sulfite ($Na_2SO_3$), sodium hyposulfite ($Na_2S_2O_3$), sodium hydrosulfite ($Na_2S_2O_4$), nano $TiO_2$ and doping nano $TiO_2$ are also commonly commercial products.

EXAMPLE 1

A method of photocatalytic white discharge printing for achieving patterns on textiles provided by this example includes the following steps:

1. Textiles are dyed with selected dyes by conventional dyeing method. The substrate is cotton fabric (dimension of 8 cm×20 cm), and the processing conditions are as common as: Reactive Red X-3B (dosage of 3.0% o.m.f), sodium sulfate (24.0 g/L), sodium carbonate (15.0 g/L), pH value of fixing formulation is 10.5, and the liquor ratio is 1 to 30; after 15 minutes dyeing at room temperature, salt is added to promote dyeing, and then for the sake of fixation, alkali is added into the bath at the time of 30 minutes. After 30 minutes' fixing, soap boiling is attempted for 2 times, whose processing conditions are employed as: soap power is 2.0 g/L, liquor ratio is 1 to 50 and the temperature and treating time is 85° C. and 15 minutes respectively.

2. Form hollow-outs decorative patterns with selected materials which are opaque and thin or thick films by physical or chemical method, so the patterned printing plates are obtained.

Refer to FIG. 1, it is the schematic of a reactor provided by present example, and it is used for achieving patterns on textiles adopting the method of white discharge batch printing. At the bottom of unit of batch processing reactor 2, there is installing an aeration device 6 which continuously passing air into the white discharging bath; In the middle of the reactor, there are installing a tube of quartz 3 and a low-pressure mercury violet lamp 4; the power supply wiring (omitting the power) is connected with the low-pressure mercury lamp which is considered as the ultraviolet light source, and the power of lamp is 8 w.

Closely integrate the hollow-outs patterned printing plates 7 and substrates 5, or the patterned printing plates 7 are fixed in one side or both sides of substrates 5; then put them in a reactor equipped with a light source and make a fine irradiation to the dyed textiles through hollow-outs of the printing-plates' patterns. With the liquor ratio of 1 to 50, the reactor employs the aqueous of potassium persulfate ($K_2S_2O_8$) whose concentration is 2 g/L as the photocatalytic discharge formulation. After adjusting the pH value to 7, turn on the lamp and hold the temperature of 25° C., then the dyed cotton fabrics are discharged as long as 30 minutes.

Wash and dry the textiles removed from the photocatalytic white discharging bath at room temperature or dry it, then the coloured products with white patterns are obtained.

Instead of potassium persulfate ($K_2S_2O_8$) used in step 3, form white patterns on textiles with other discharging agents such as hydrogen peroxide ($H_2O_2$), sodium sulfite ($Na_2SO_3$), sodium hyposulfite ($Na_2S_2O_3$), sodium hydrosulfite ($Na_2S_2O_4$), nano $TiO_2$ and doping nano $TiO_2$.

With reference to the processing steps above, regard the experiment of cotton fabrics treated by pure water (i.e. no addition of photocatalytic white discharging agent) as the blank controlled trial, and make a comparison of measurements of whiteness and strength on cottons fabrics treated by photocatalytic discharging agents and the blank sample. The results are as follows.

Measurement of Whiteness

The whiteness of white patterns on the fabrics are measured by Intelligent Digital Whiteness Measurer WSB-3A, choosing three different positions and taking the average value as the fabric whiteness value (R457).

Figure 2:
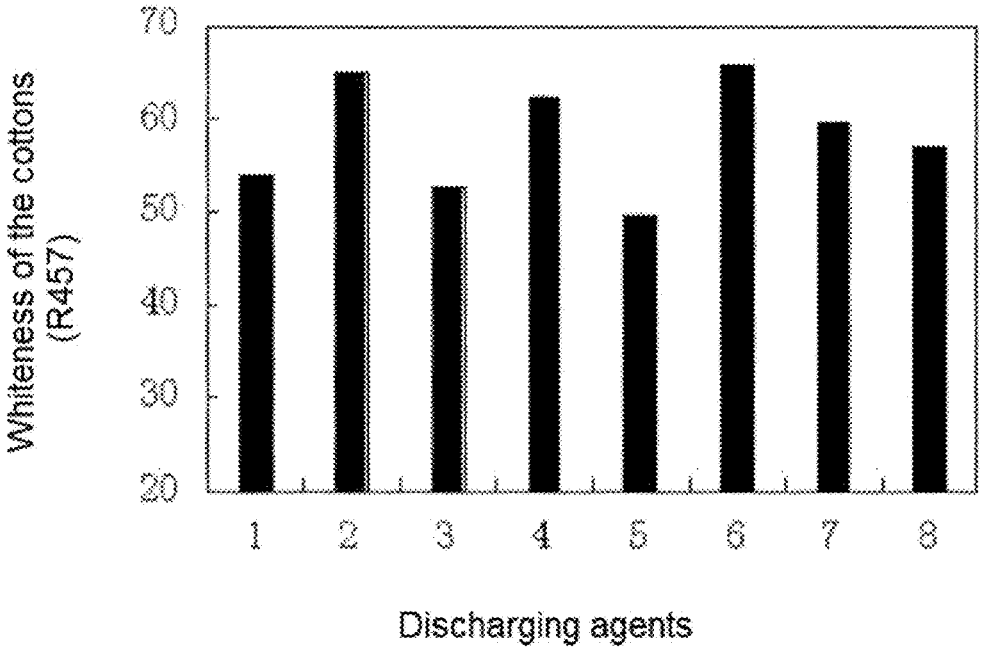
FIG. 2 of the drawings is the whiteness of cottons discharged by different kinds of discharging agents as example 1 recited.

Refer to FIG. 2, it is the schematic of effect of white discharge printing using different white discharging agents with cotton fabrics dyed by Reactive Red X-3B. In the figure: 1 is water (blank controlled trial); 2 is potassium persulfate; 3 is hydrogen peroxide; 4 is sodium sulfite; 5 is sodium hyposulfite; 6 is sodium hydrosulfite; 7 is nano $TiO_2$; 8 is doping nano $TiO_2$. From the view of FIG. 2, as the catalysis of ultraviolet light, the ground shade dyes on fabrics can be discharged by the seven different kinds of photocatalytic discharging agents, so as the water. However, there are obvious differences in the whiteness of white patterns. The effect of potassium persulfate, sodium hydrosulfite and sodium sulfite are better, that whiteness values can reach 60 or above.

Measurement of Strength of Fabrics

According to the standard of GB/T 3923.1-1997, the breaking strength of fabrics is measured by Electronic Fabric Strength Apparatus YG026B with the method of strip. Table 1 is the results of breaking strength of dyed fabrics discharged by diverse photocatalytic white discharging agents.

TABLE 1

Warp-direction strength of dyed fabrics after photocatalytic white discharge printing

| photocatalytic white discharging agent | Strength of the fabric (warp-direction, N) |
|---|---|
| dyed cotton fabric | 355.0 |
| blank controlled trial (pure water) | 330.0 |
| potassium persulfate ($K_2S_2O_8$) | 324.5 |
| hydrogen peroxide ($H_2O_2$) | 329.0 |
| sodium sulfite ($Na_2SO_3$) | 345.0 |
| sodium hyposulfite ($Na_2S_2O_3$) | 342.5 |
| sodium hydrosulfite ($Na_2S_2O_4$) | 353.0 |
| nano $TiO_2$ | 325.5 |
| doping nano $TiO_2$ | 331.0 |

Table 1 reveals a fact that, after the treatment with photocatalytic oxidants, the warp-direction strength of fabrics has been reduced to a certain degree, yet fabrics keep higher tensile breaking strength with the treatment of reducing agents. Due to the oxidizability of ultraviolet light itself accompanying with the effect of oxidants, the loss of fabrics' strength is larger; while the existence of reducing agents reducing the damage on fibers, effect on its strength is less.

As the effect of white discharge printing with system of potassium persulfate is better than other systems, white discharge printing for achieving patterns on dyed cotton fabrics are attempted with the instance of potassium persulfate.

EXAMPLE 2

Figure 3:
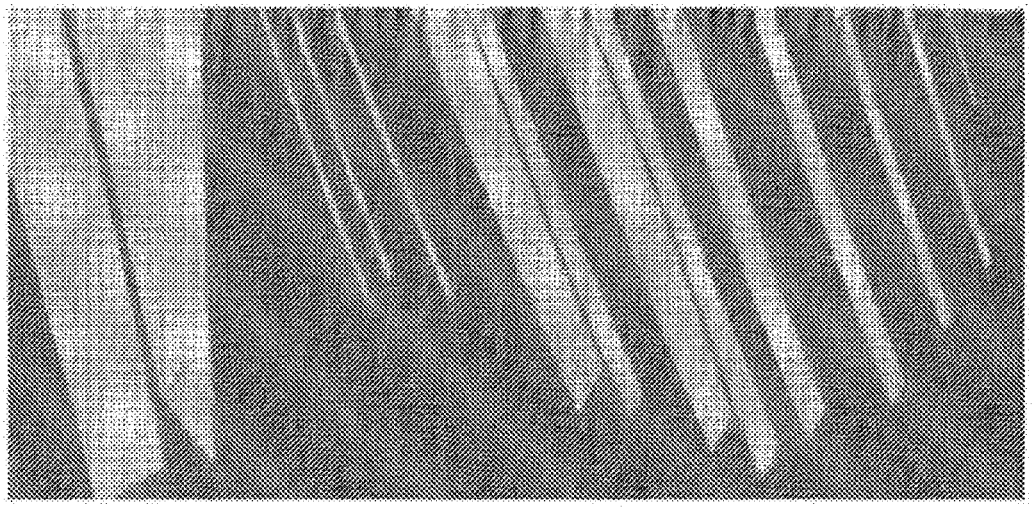
FIG. 3 of the drawings presents the effect of white discharge printing process as example 2 recited.

Some steps are the same of example 1 of the method of photocatalytic white discharge printing for achieving patterns on textiles provided by this invention. In the step 1, the ground shade dye is Reactive Red X-3B; the patterns on printing-plate are lines with different widths or the diamonds (used for the measurement of sharpness of patterns) in step 2; the dyed cottons are white-discharged as long as 35 minutes by the aqueous of potassium persulfate whose concentration is 4.0 g/L and pH value is 10 in step 3. The result can be seen in FIG. 3, the ground shade is red, and the pattern is white lines and cuneate figures with high sharpness.

EXAMPLE 3

Figure 4:
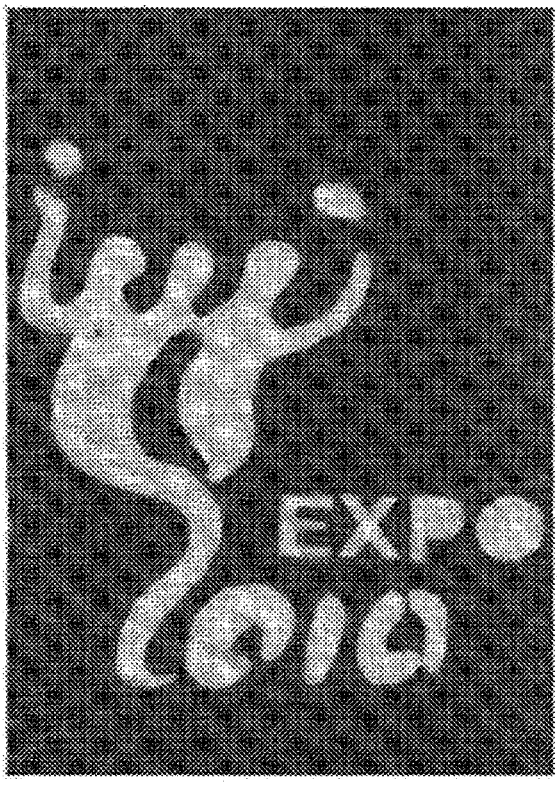
FIG. 4 of the drawings illustrates the effect of white discharge printing as example 3 recited.

Steps of the method of photocatalytic white discharge printing for achieving patterns on textiles provided by this invention can refer to example 1. The pattern on printing-plate is the logo of 2010 Shanghai World Expo in step 2; the dyed cottons are white-discharged as long as 35 minutes by the aqueous of potassium persulfate whose concentration is 4.0 g/L and pH value is 10 in step 3. The result can be seen in FIG. 4, the ground shade is red, and the pattern is a white logo of Shanghai World Expo.

EXAMPLE 4

Figure 5:
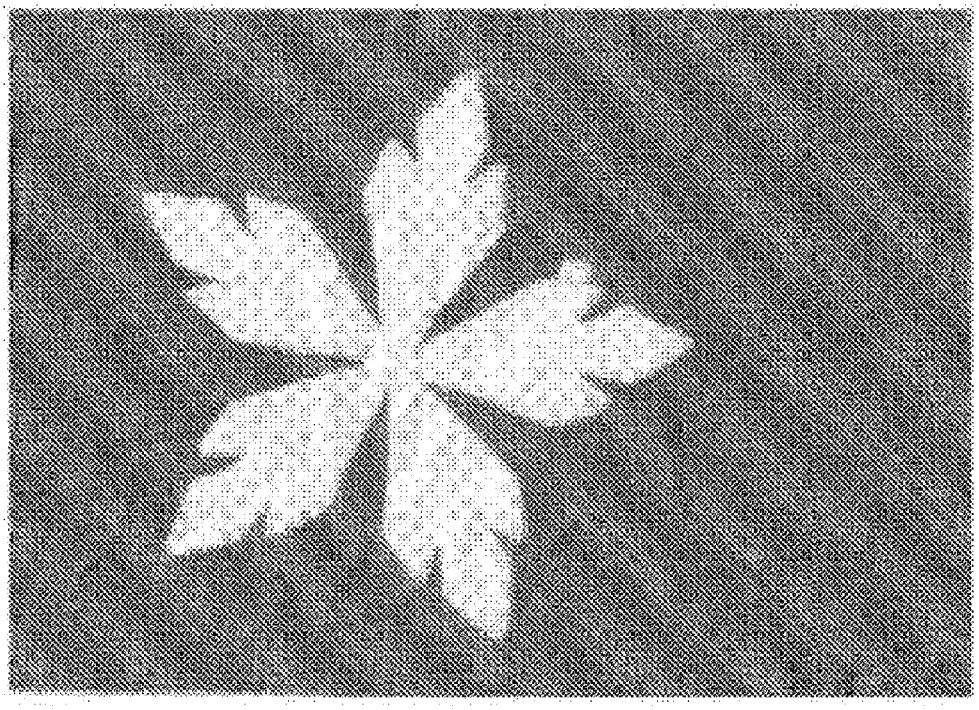
FIG. 5 of the drawings illustrates the effect of white discharge printing as example 4 recited.

Steps of the method of photocatalytic white discharge printing for achieving patterns on textiles provided by this invention can refer to example 1. The pattern on printing-plate is a design for snow in step 2; the dyed cottons are white-discharged as long as 35 minutes by the aqueous of potassium persulfate whose concentration is 4.0 g/L and pH value is 10 in step 3. The result can be seen in FIG. 5, the ground shade is red, and the pattern is a white snow.

EXAMPLE 5

Figure 6:
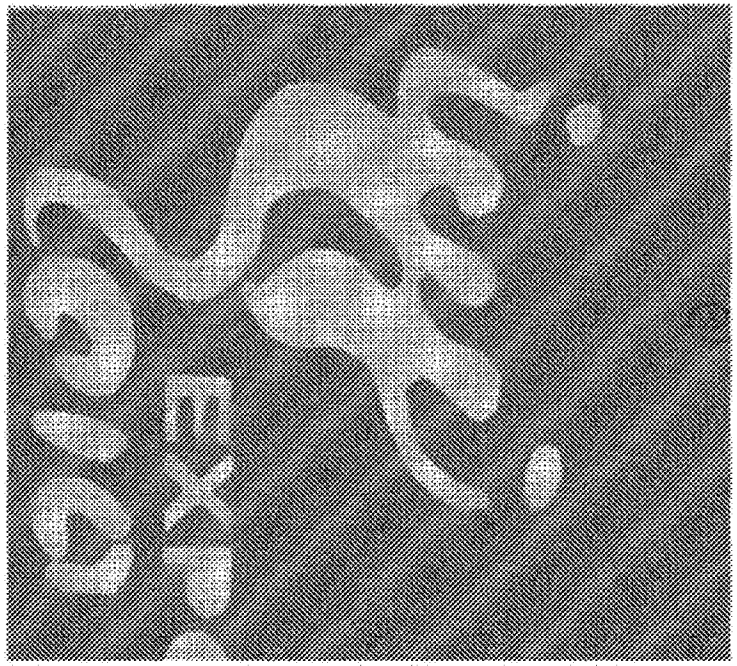
FIG. 6 of the drawings illustrates the effect of white discharge printing with cottons that combination dyed as example 5 recited.

Steps of the method of photocatalytic white discharge printing for achieving patterns on textiles provided by this invention can refer to example 1. In step 1, the ground shade dye (dosage of 3.0% o.m.f) is the combination of Reactive Red M-3BE and Reactive Blue 222BF whose mass ratio is 1 to 1, dyeing and fixing at the temperature of 60° C. and 80° C. respectively; the pattern on printing-plate is the logo of 2010 Shanghai World Expo in step 2; the dyed cottons are white-discharged as long as 35 minutes by the aqueous of potassium persulfate whose concentration is 4.0 g/L and pH value is 10 in step 3. The result can be seen in FIG. 6, the ground shade is navy blue, and the pattern is A white logo of Shanghai World Expo.

As can be seen from FIG. 3, FIG. 4, FIG. 5 and FIG. 6, there is no denying that employing the system of UV/$K_2S_2O_8$ can not only urge the cotton fabrics dyed with a single dye to be discharged, but also it is suitable for the cotton fabrics combination dyed. Furthermore, ideal decorative patterns on fabrics with higher sharpness, white ground noise-free, relaxed cloth and pure color are obtained, just as the same effect of conventional printing.

The invention making a feature of photocatalytic white discharge printing technology, can be implemented on various types of textiles that ground dyed with all kinds of decorative patterns. At the same time, the invention belongs to the typical short and cleaner production process that it eliminates the need for printing pastes and expensive printing apparatuses as well as steaming and desizing, the conventional printing process. Besides, it has the characteristics of simple equipment and process, short processing, and effluent free. Thus, it has a very brilliant prospect of application.

We claim:

1. A method of photocatalytic white discharge printing for achieving patterns on textiles consisting of the following steps:

a) dye the textiles with dyes to obtain dyed textiles;

b) form hollow-outs decorative patterns according to required patterns with materials which are opaque and thin or thick films plates by a physical or chemical method, so patterned printing plates are obtained;

c) closely integrate the patterned printing plates and the dyed textiles or fix the patterned printing plates on one or both sides of the dyed textiles, then put the dyed textiles in a reactor equipped with a light source and occupied by a photocatalytic white discharge formulation, pump air or oxygen into the reactor, open the light source, directly expose the dyed textiles through the hollow-outs in the patterned printing plates, and treat the dyed textiles for about 1-90 minutes at temperatures ranging from 5° C. to 70° C., wherein the photocatalytic white discharge formulation contains potassium persulfate at a concentration of 0.10 g/L-10.00 g/L and the formulation has a pH value of 2-12;

d) wash and dry the dyed textiles removed from the photocatalytic white discharging bath at room temperature.

2. A method of photocatalytic white discharge printing for achieving patterns on textiles as recited in claim 1, wherein the dyes are one of C.I. Reactive Red 2, C.I. Reactive Red 195 and C.I. Reactive Blue 222, or any combination thereof.

3. A method of photocatalytic white discharge printing for achieving patterns on textiles as recited in claim 1, wherein the patterned printing plates are produced by mechanical or manual engraving, or laser etching.

4. A method of photocatalytic white discharge printing for achieving patterns on textiles as recited in claim 1, wherein the light source is ultraviolet or visible light, whose power is 5~500 w.

* * * * *